United States Patent [19]

Lake

[11] Patent Number: 4,657,173

[45] Date of Patent: Apr. 14, 1987

[54] DIVIDED CELL CARTON WITH RESILIENT BIASING MEMBERS

[75] Inventor: Connie Lake, Tinley Park, Ill.

[73] Assignee: S. Eisenberg & Co., Bridgeview, Ill.

[21] Appl. No.: 790,947

[22] Filed: Oct. 24, 1985

[51] Int. Cl.[4] ..... B65D 85/32

[52] U.S. Cl. ..... 229/2.5 EC; 229/29 M; 229/44 EC

[58] Field of Search ..... 229/2.5 EC, 29 M, 44 EC, 229/45 EC; 206/45.14, 45.15; 217/26.5

[56] References Cited

U.S. PATENT DOCUMENTS

| | | | |
|---|---|---|---|
| 2,971,685 | 2/1961 | Treida | 229/2.5 EC |
| 3,749,235 | 7/1973 | Boursier | 229/2.5 EC |
| 3,771,712 | 11/1973 | Richards | 229/2.5 EC |
| 3,980,221 | 9/1976 | Okada . | |
| 4,193,531 | 3/1980 | Saby . | |
| 4,462,537 | 7/1984 | Grootherder . | |
| 4,480,781 | 11/1984 | Emery et al. | 229/2.5 EC |
| 4,609,141 | 9/1986 | Lake | 229/2.5 EC |

FOREIGN PATENT DOCUMENTS

| | | | |
|---|---|---|---|
| 182075 | 5/1955 | Austria . | |
| 4441 | 10/1979 | European Pat. Off. | 229/2.5 EC |
| 945136 | 6/1956 | Fed. Rep. of Germany . | |
| 2927665 | 1/1981 | Fed. Rep. of Germany . | |
| 1172220 | 2/1959 | France | 229/2.5 EC |
| 2424858 | 1/1980 | France . | |
| 319421 | 12/1970 | Sweden . | |
| 797479 | 7/1958 | United Kingdom . | |
| 932669 | 7/1963 | United Kingdom . | |
| 1182105 | 2/1970 | United Kingdom | 229/2.5 EC |

OTHER PUBLICATIONS

Drawings of Connie Lake U.S. application Ser. No. 602,637, filed Apr. 25, 1984.

*Primary Examiner*—George E. Lowrance
*Assistant Examiner*—Gary E. Elkins

[57] ABSTRACT

A divided cell carton for fragile articles, such as eggs, has a tray portion with divider walls providing a plurality of open top cells and a lid portion with a central longitudinal channel having alternating depending struts bottoming on the divider walls and depending straps between the struts. Each strap has a pair of opposed resilient fingers positioned to bias the articles in adjacent cells against the bottoms and sides of the cell walls for firmly seating the articles in the cells. The inner ends of the fingers of each pair are connected by a resilient bridge acting as a hair pin spring to stiffen the fingers. The bridge configuration may have many different forms to suit conditions so that the fingers will be effective to act on articles of different sizes in the cells, thus providing a standard size carton that can safely house articles of many different sizes.

19 Claims, 14 Drawing Figures

FIG. 4
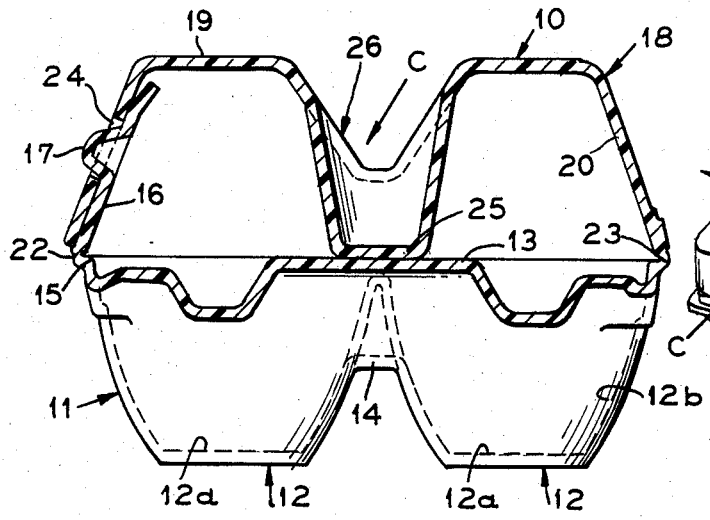
FIG. 1A
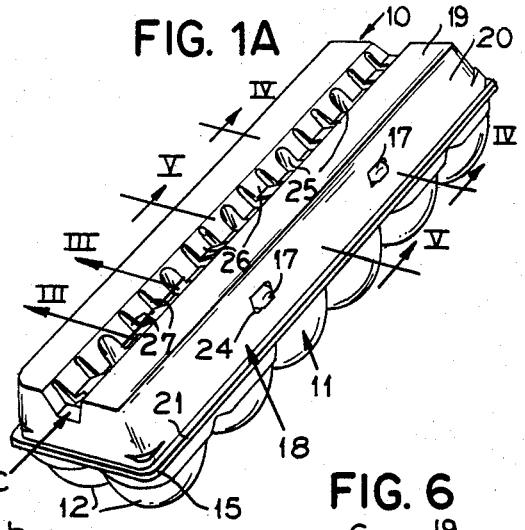
FIG. 6
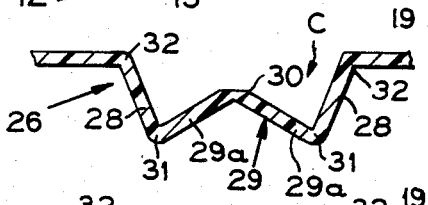
FIG. 5
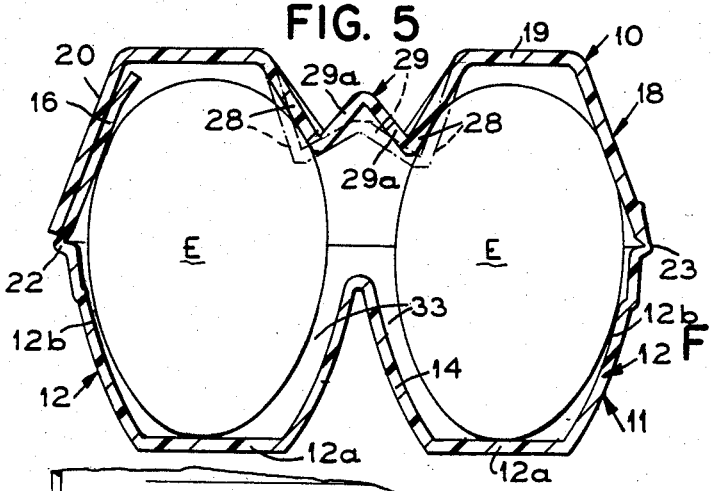
FIG. 7
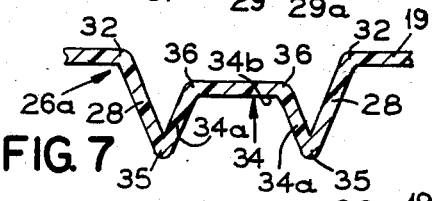
FIG. 8
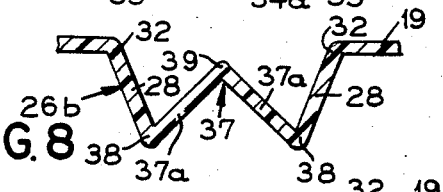
FIG. 9
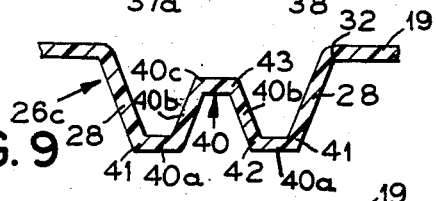
FIG. 10
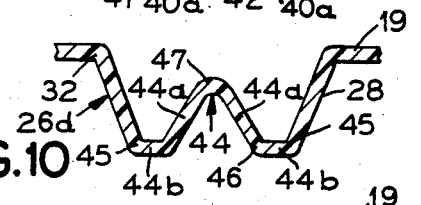
FIG. 11
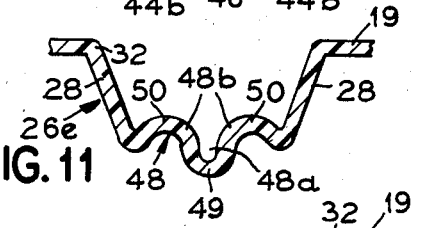
FIG. 12
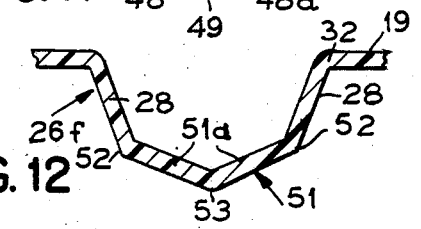
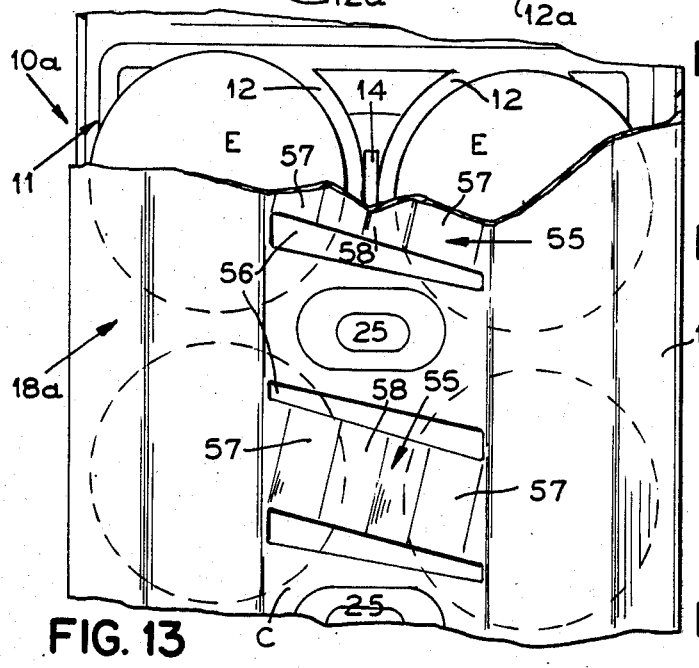
FIG. 13

DIVIDED CELL CARTON WITH RESILIENT BIASING MEMBERS

BACKGROUND OF THE INVENTION

1. Field of the Invention

This invention relates to the art of divided cell cartons, particularly egg cartons, which spring bias articles firmly into the cells. Specifically this invention relates to molded plastic egg cartons having a tray with a plurality of rows of open top side-by-side egg-shaped cells with a lid hinged to the tray having depending straps defining pairs of connected spring fingers positioned to resiliently bias articles in adjacent cells toward the bottoms and sides of the cells and thereby extend the use of the carton to house eggs of different sizes.

2. Description of the Prior Art

Heretofore, cellular egg cartons had to be provided for each egg size range. Generally, such cartons were made with cell sizes accommodating both small and medium size eggs or large and extra large jumbo size eggs. When small eggs are packaged in a carton having cells large enough to accommodate medium size eggs and when large eggs are packaged in a carton designed to also receive extra large jumbo eggs, the small and large eggs will fit very loosely in their respective cartons, increasing the probability of breakage. Further, since eggs within a particular lot size can vary greatly in size and shape, even those cartons which were specifically designed for a particular lot size have failed to snuggly package all eggs within that lot size.

It would therefor be an improvement in this art to provide a divided cell carton, such as an egg carton with spring straps which bias a pair of articles in adjacent cells into firm nested engagement with the bottom and side walls of their cells. It would be a further specific improvement in this art to provide the straps with resilient hair pin spring bridge connections between fingers engaging the articles.

SUMMARY OF THE INVENTION

The present invention provides molded, preferably plastic, divided cell cartons for fragile articles, such as eggs, with resilient biasing members each acting on a plurality of articles to seat them firmly in their cells. The cartons of this invention have a tray portion and a lid portion hinged together longitudinally along one side. The tray portion is divided into a plurality of rows of side-by-side cells, preferably semi-ovate egg cells, formed by a longitudinally extending divider and transversely extending dividers. The lid portion has a top with biasing straps depending therefrom with each strap providing a pair of connected resilient fingers. The fingers are positioned to engage the upper top sides of articles in adjacent cells and the inner ends of each pair of fingers project below the top of the lid are joined by a bridge shaped to accommodate deflection of the fingers toward each other but adding resistance to such deflection thereby acting as a hair pin spring to stiffen the fingers. The preferred bridge shapes include a plurality of legs connected by bending joints. The central zone of each bridge is positioned so that when the lid is closed it will lie above the longitudinal divider of the tray with the fingers at the ends of the bridge overlying adjacent cells. The straps may extend transversely or diagonally to position the spring fingers for acting on the side-by-side articles. In this manner the articles, such as eggs, are pushed against an opposite side wall in a downward direction to firmly seat in the cell and eliminate any looseness which might otherwise occur in cells accommodating articles of different sizes.

It is then an object of this invention to provide a divided cell carton capable of housing different sized articles in individual cells with pairs of connected fingers biasing adjacent articles firmly into their cells.

A further object of the invention is to provide a molded divided cell carton having a plurality of lid means each biasing a pair of adjacent articles firmly into their cells.

A specific object of this invention is to provide a molded plastic cellular egg carton with a lid having a longitudinal row of depending resilient transverse straps configured to bias articles in adjoining cells downwardly and sidewise into firm engagement with the cell walls.

A further and specific object of the invention is to provide an egg cell carton lid with depending egg biasing spring fingers connected at their inner ends by a resilient bridge acting as a hair pin spring to stiffen the fingers.

Other and further objects and features of this invention will become apparent to those skilled in this art from the following detailed description of the annexed two sheets of drawings which, by way of example only, illustrate two best mode embodiments of the invention.

On the Drawings:

FIG. 1A (sheet 2) is a view similar to FIG. 1 but showing the carton in a closed position.

FIG. 4 is a transverse sectional view of the carton taken along the line IV—IV of FIG. 1A. of a transversely extending divider wall.

FIG. 5 is a transverse sectional view of the carton taken along the line V—V of FIG. 1A.

FIG. 6 is an enlarged fragmentary section view of the biasing strap of the carton lid with the pair of spring fingers connected at their inner ends by a hair pin spring bridge having two upwardly inclined legs.

FIGS. 7 through 12 are views similar to FIG. 6 but showing modifications of biasing strap configurations of this invention.

FIG. 13 is a fragmentary top plan view, with parts broken away, of a modified carton having the lid straps extending diagonally.

DESCRIPTION OF THE ILLUSTRATED PREFERRED EMBODIMENTS

Figure 1:
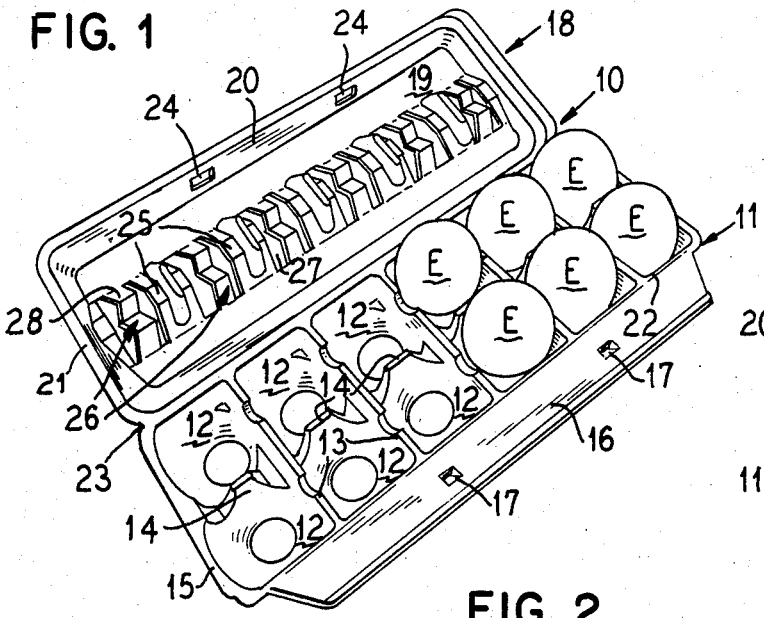
FIG. 1 is a perspective view of a cellular egg carton of this invention in an open position and a partially filled with eggs.
Figure 3:
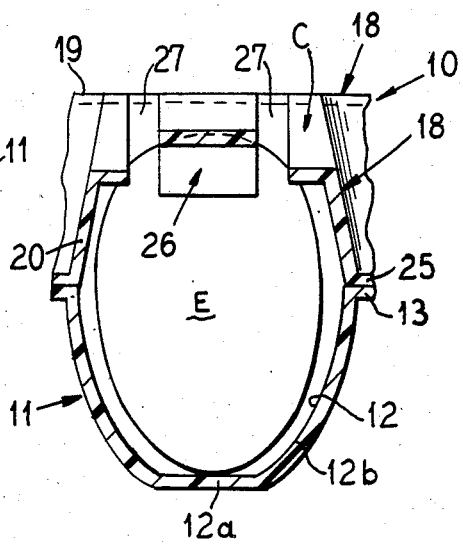
FIG. 3 is a fragmentary longitudinal cross-sectional view of one of the cells of the carton taken along the line III—III of FIG. 1A.
Figure 2:
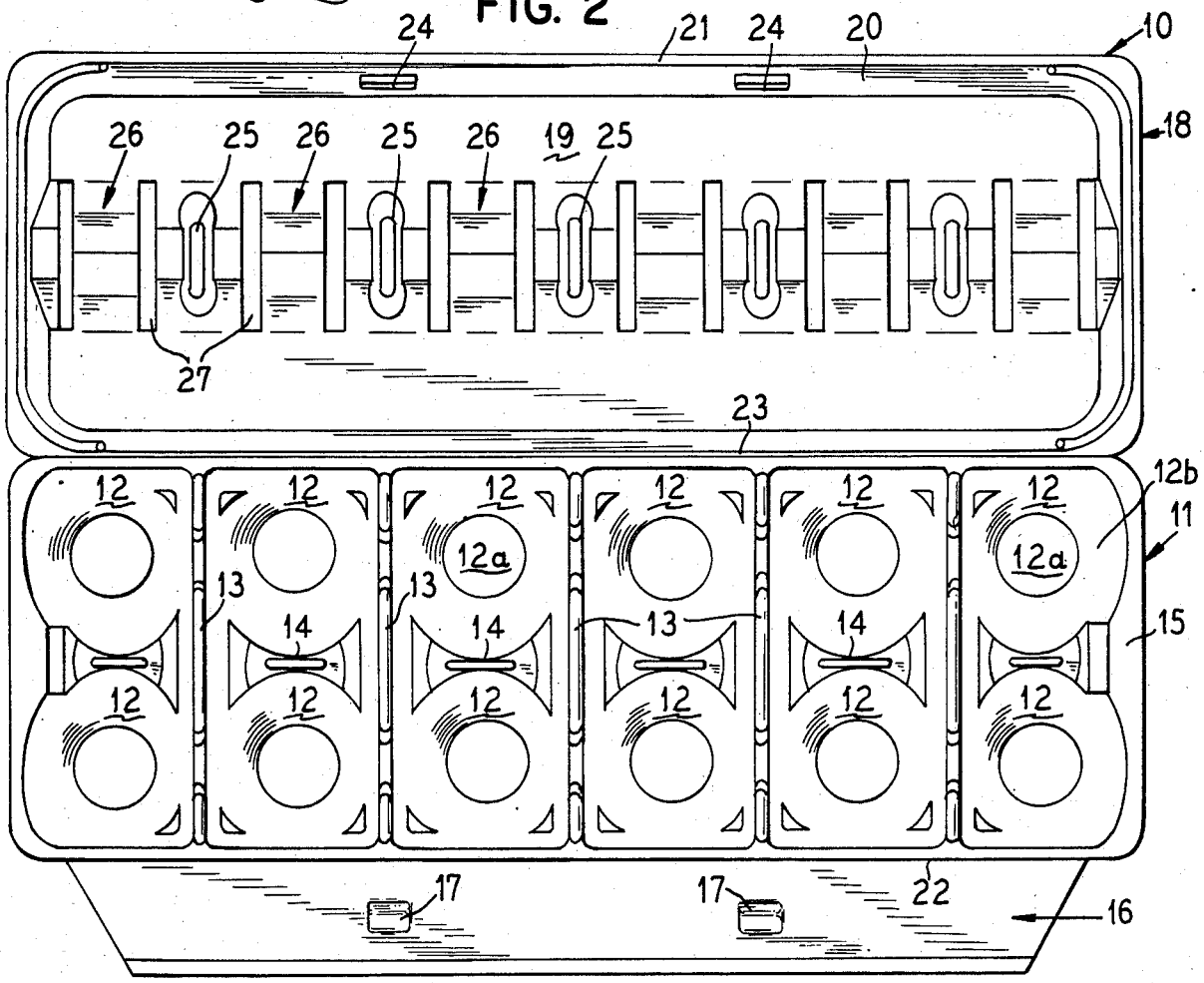
FIG. 2 is a top plan view of the carton of FIG. 1 in the open position.

The carton 10 of FIGS. 1, 1A and 2 is a one piece molded plastic member having a bottom tray portion 11 with two rows of six semi-ovate egg cells 12 in side-by-side relation formed by transverse extending parallel divider walls 13 and longitudinal divider walls 14 cooperating with the transverse walls to form the semi-ovate shaped cells. The tray is rectangular with a flat peripheral rim 15 around the open top thereof.

The cells 12 preferably have flat bottoms **12*a* and diverging side walls 12*b* merging at their open tops into the transverse walls 13 and divider walls 14**.

A locking flap 16 is hingedly integrated along its length with the rim portion 15 of the tray and has a pair of depressions 17 forming a projection on the bottom face thereof for a purpose hereinafter described.

The carton 10 has a lid 18 having a central longitudinal channel C along the length thereof as best shown in FIG. 1A, with a generally flat top 19 and a depending peripheral skirt 20 with a rim end 21 adapted to seat on the rim 15 of the tray 11 in the closed position of the lid.

The tray 11, flap 16, and lid 18 are molded in one piece with the flap connected to the front wall of the periphery of the tray at a hinge line 22 and with the lid connected to the rear wall of the tray rim by a hinge line 23.

In the closed position of the carton 10, the rim 21 of the lid skirt 20 mates with the rim 15 of the tray and the height of the skirt holds the top wall 19 of the lid in spaced relation above the open tops of the cells 12. Also in the closed position, the flap 16 is snapped inwardly under the front wall of the lid skirt 20 as shown in FIG. 4 and the projections 17 snap into mating apertures 24 of the skirt front wall.

The channel portion C of the top wall 19 of the lid 18 has depending abutment fingers 25 positioned to rest on the tops of the transverse divider walls 13 in the closed carton position to cooperate therewith in forming upstanding struts preventing collapse of the cover into the cells 12. Alternately, these fingers could be positioned to bottom on the tops of the longitudinal divider walls 14.

According to this invention, transverse strap portions 26 in the channel C alternate with the fingers 25. These straps also depend from the top wall 19 of the lid or cover and are isolated by slots 27 on each side thereof separating the straps from the fingers 25.

Each strap 26 has a pair of oppositely inclined spring fingers 28, best shown in FIG. 6, joined at their inner ends by a connecting bridge 29 which is depressed upwardly from the inner ends of the legs to a bending crown 30. Bending zones 31 are provided between the bridge 29 and the inner ends of the spring fingers 28. The bridge 29 thus acts as a hair pin spring against the spring fingers 28 to accommodate but stiffen swinging of the fingers relative to the top wall 19.

As illustrated in FIG. 5, eggs E seated in side-by-side relation in the cells 12 of adjoining rows of cells when bottomed on the flat bottoms **12*a* of these cells will project above the tray 11 into the lid 18 with their top inner side portions abutting the spring fingers 28 and deflecting these fingers from their free dotted line positions to the illustrated solid line positions. The eggs are thus urged downwardly and outwardly to firmly seat on the bottom cell walls 12*a* and the outer side cell walls 12*b*. Further, the portions of the eggs projecting above the tray 11 will be urged laterally outward into firm relationship with the skirt portion 20 of the lid. The eggs in the back row of cells will directly engage the skirt 20 while the eggs in the front row of cells may directly engage the inner face of the flap 16 underlying the front skirt 20** as shown.

It will be understood that as the lid 18 is swung to its closed position, the flap 16 is swung upwardly and inwardly to underlie the front skirt 20 of the lid. Then, as the spring fingers 28 of the straps 26 ride into contact with the top inner side portions of the eggs E they will be squeezed toward each other causing the bending zones 30 and 31 of the connecting bridge 29 to decrease the included angles thereof and bringing the side legs **29*a* of the bridge closer together. The fingers 28 also swing about the bending zones 32 integrating their outer, or top, ends with the top wall 19 of the lid 18 on each side of the channel C. These bending zones 30, 31 and 32 thus accommodate swinging of the spring fingers 28 relative to the top wall 19 of the lid with the bridge 29 acting as a hairpin spring stiffening this swinging movement and adding to the force of the fingers in urging the eggs into firm seated engagement with their cells. As shown in FIG. 5, the cells 12 are large enough to house larger size eggs but the springs 28 urge the illustrated smaller eggs laterally outward leaving a space or gap 33 between the egg and the longitudinal dividing wall 14 while maintaining the eggs firmly seated in the cells. Larger sized eggs completely filling the cells 12 will, of course, deflect the spring fingers 28 causing them to exert more downward action on the eggs. The tops of the eggs are thus held in spaced relation from the top wall 19** of the lid.

FIGS. 7–9 illustrate various modifications for the straps 26, all of which provide the same type of spring fingers 28 as illustrated in FIG. 6 but vary the bridge or hairpin spring connection between the fingers.

Thus as illustrated in FIG. 7, the modified strap **26*a* has an inverted U-shaped bridge 34 with side legs 34*a* diverging to the inner ends of the spring fingers 28 and providing bending zones 35 between the fingers and legs. In addition, the bridge has bending zones 36 between the side legs 34*a* and the bight portion 34*b*** thereof.

The strap **26*b* of FIG. 8 has an angle leg bridge 37 with side legs 37*a* in right angle relation. The divergent ends of the legs 37*a* are connected to the inner ends of the spring fingers at bending zones 38. A right angle bending zone 39 is provided between the legs 37*a*** at the apex of the legs.

The strap **26*c* of FIG. 9 has a bridge 40 connecting the inner ends of the spring fingers 28 with a configuration providing horizontal bottom legs 40*a*, inclined side legs 40*b* and a top leg 40*c* connecting the tops of the inclined legs 40*b*. In this configuration, each spring finger 28 is connected at a bending zone 41 with the legs or flanges 40*a*, the legs 40*a* in turn are connected to their inclined legs at bending zones 42 and the converging top ends of the inclined legs 40*b* are connected to the top leg 40*c* at bending zones 43**.

The strap **26*d* of FIG. 10 has an inverted V-shaped bridge 44 with diverging sides 44*a* and horizontal outturned flanges 44*b* connected to the inner ends of the spring fingers 28 at bending zones 45. The sides 44*a* in turn are connected to the flanges 44*b* at bending zones 46. Then these inclined sides 44*a* are connected together at a rounded apex bending zone 47**.

The strap **26*e* of FIG. 11 has a bridge 48 of a convoluted shape with a down-turned U-shaped central portion 48*a* and inverted U-shaped side portions 48*b* providing an open top bottom bending zone 49 and a pair of open bottom top bending zones 50. In this arrangement, the convoluted U-shaped portions 48*a* and 48*b* have arcuate bending zones 49 and 50**.

The strap **26*f* of FIG. 12 has a bridge 51 with downwardly sloping legs 51*a* joining the inner ends of the spring fingers 28 at bending zones 52. The legs 51*a* in turn are joined at a central bottom bending zone 53**.

It will therefore be understood that the configurations of the bridges connecting the inner ends of the spring fingers 28 may be varied widely to provide desired hairpin springs stiffening the spring fingers 28. The configuration can be varied to suit differences in cell design and the loads placed on the eggs to seat them firmly in their cells.

The modified carton 10*a* of FIG. 13 has illustrated components identical with those described above in connection with the carton 10 marked with the same reference numerals. As shown, the tray 11 is identical with the tray 11 of the carton 10 but a modified lid 18*a* is provided. This lid 18*a* has diagonal straps 55 instead of the transverse straps 26 of the carton 10 and, as shown, these diagonal straps alternate with the divider walls 25 being separated therefrom by diagonal slots 56. The straps have spring fingers 57 acting on the side-by-side eggs in the adjoining rows in a direction which urges them outwardly and longitudinally to seat on the side walls of the cells 12. The diagonally arranged spring fingers 57 thus have force components with opposite longitudinal vectors so that the eggs in one row will be urged longitudinally in one direction while the eggs in the other row will be urged longitudinally in the opposite direction. At the same time, however, the eggs in both rows are urged laterally outward. The pairs of fingers 57 are connected by a bridge 58 which can have any one of the forms illustrated in FIGS. 6–12.

From the above descriptions, it will therefore be abundantly clear that this invention provides cellular cartons for fragile articles, such as eggs, with spring fingers depending from the lid thereof arranged in pairs and connected by a bridge member acting as a hairpin spring which stiffens the fingers.

Although the teachings of my invention has herein been discussed with reference to specific theories and embodiments, it is to be understood that these are by way of illustration only and that others may wish to utilize my invention in different designs or applications.

I claim:

1. A carton especially adapted for housing fragile articles, such as eggs, which comprises an open top tray having adjacent open top article receiving cells, a lid closing said tray having a top wall with pairs of spaced opposed depending spring fingers isolated from the top wall by slots along the length of the fingers, with each pair of fingers positioned to engage articles in two adjacent cells, said fingers having inner ends spaced below the top wall of the lid and outer ends connected to said top wall, and a flexible bridge connecting said inner ends of the spring fingers of each pair to stiffen the spring effect of the fingers as they engage the articles.

2. The carton of claim 1, wherein the lid has a central longitudinal channel and the spring fingers and bridge define straps across said channel.

3. The carton of claim 2, wherein said straps extend transversely across the channel.

4. The carton of claim 2, wherein straps extend diagonally across said channel.

5. The carton of claim 1, wherein the flexible bridge has legs with bending zones connected to the inner ends of the spring fingers.

6. The carton of claim 1, wherein the bridge has a raised central portion.

7. The carton of claim 1, wherein the bridge has a depending central portion with bending zones.

8. The carton of claim 1 wherein the bridge has a pair of laterally extending flanges connected to the inner ends of the spring fingers at bending zones and an inverted U-shaped central portion connecting the flanges through bending zones.

9. The carton of claim 1, wherein the bridge is convoluted and connected to the inner ends of the spring fingers at bending zones.

10. The carton of claim 1 wherein the bridge has downwardly inclined legs joined by a central bending zone.

11. A carton adapted for housing a plurality of relatively fragile articles having upper side portions such as eggs, which comprises an open top tray having a plurality of longitudinal rows of adjacent article receiving cells with the cells in each row being transversely aligned, a lid closing the open top of said tray having a top wall with inwardly depending straps with sides along the length thereof isolated from the top wall by slots, each strap positioned to overlie a pair of adjacent cells, said straps having an inclined spring fingers for engaging the upper side portions of the articles in two adjacent cells to urge the articles downwardly and laterally into firm engagement with the cell walls, said spring fingers having inner ends spaced below the top wall of the lid, and a hairpin spring bridge connecting said inner ends of the fingers of each pair to stiffen the spring effect of the fingers on the articles.

12. The carton of claim 11 including longitudinal and transverse divider walls between the cells and depending struts on the lid between the straps for engaging the divider walls.

13. The carton of claim 11, wherein the lid has a central depressed longitudinal channel with the straps extending transversely thereacross.

14. The carton of claim 13, wherein the straps extend diagonally across the channel.

15. The carton of claim 11 wherein the flat top wall of the lid has a longitudinal depressed channel along the length thereof, the spring fingers depend from the top wall into the channel and the bridge forms a bottom wall portion of the channel.

16. The carton of claim 15, including depressed strut walls depending from the top wall in the channel alternating with the straps for bottoming on the tops of the cells.

17. A molded one-piece egg carton having an open top tray with divider walls defining two rows of adjacent open top egg cells with the cells in each row being transversely aligned, said egg cells bottoming eggs therein and exposing top side portions of the eggs, said tray having a top peripheral rim with front and rear sides, a locking flap hinged on the front side of the rim, a closure lid having a top wall with a depending peripheral skirt mating with the rim of the tray, said skirt having a front side and a back side, said back side being hinged on the rear side of the rim, said top wall of the lid having a central depressed channel along the length thereof, said channel having alternate separator strut portions bottomed on the tops of divider walls of the tray and flexible straps isolated from said strut portions by slots along the length of each strap, each strap overlying two adjacent cells of the tray when the lid is closed, each strap having a pair of opposed spring fingers with inner ends spaced below the top wall of the lid, the inner ends of said spring fingers of each pair being connected by a hairpin spring bridge stiffening the spring fingers, the front side of the skirt of the lid receiving the closure flap of the tray in the closed position of the carton, cooperating projections and recesses on the flap and front side of the shirt to lock the lid and tray together, and the spring fingers of the straps being positioned to engage the top side portions of eggs in the cell to urge the eggs downwardly and laterally into their cells into firm engagement with a side wall of each cell.

18. The egg carton of claim 17, wherein the straps extend transversely across the channel.

19. The egg carton of claim 17 wherein the straps extend diagonally across the channel.

* * * * *